United States Patent [19]

Eichelbaum

[11] Patent Number: 4,949,566

[45] Date of Patent: Aug. 21, 1990

[54] ROLLING MILL LUBRICATION

[76] Inventor: Robert Eichelbaum, 2509 Scarsborough Dr., Richmond, Va. 23235

[21] Appl. No.: 405,655

[22] Filed: Sep. 11, 1989

[51] Int. Cl.[5] ..... B21B 27/10; B21B 45/02

[52] U.S. Cl. ..... 72/42; 72/236

[58] Field of Search ..... 72/42, 46, 236; 252/52 R, 52 A

[56] References Cited

U.S. PATENT DOCUMENTS

| | | | |
|---|---|---|---|
| 2,813,129 | 11/1957 | Benoit | 252/52 A |
| 3,124,531 | 3/1964 | Whetzel et al. | 72/42 X |
| 3,505,844 | 4/1970 | McLean | 72/42 |
| 4,315,421 | 2/1982 | Wilson | 72/42 |
| 4,781,847 | 11/1988 | Weitz | 252/52 A |

*Primary Examiner*—E. Michael Combs

*Attorney, Agent, or Firm*—John F. C. Glenn

[57] ABSTRACT

Cold rolling metal strip with a rolling lubricant of petroleum solvent mixed with polyalkylene glycol. Where a sump collects said rolling lubricant after use for reuse in such rolling, also using mixtures of such components to lubricate parts of the rolling mill where leakage of the parts lubricants could be collected in the sump.

8 Claims, 1 Drawing Sheet

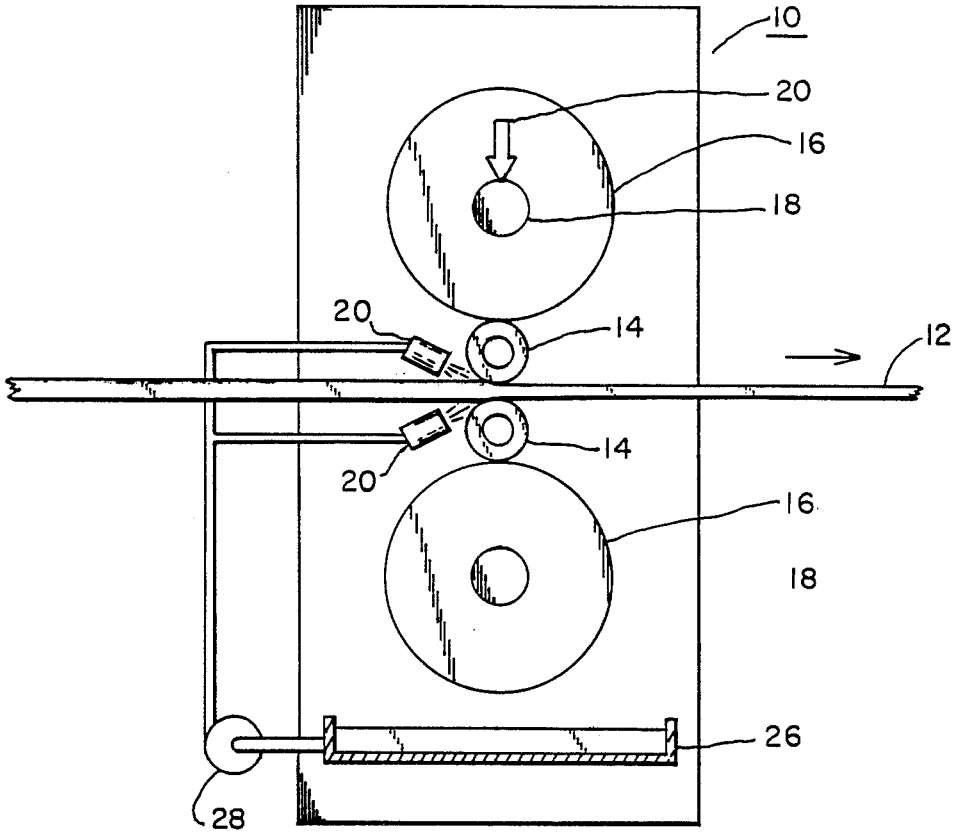
10
20
16
18
20
14
12
14
20
16
18
26
28

ROLLING MILL LUBRICATION

BACKGROUND OF THE INVENTION

After initial hot rolling, aluminum base alloy strip and other metal strips are conventionally cold rolled with a lubricant of petroleum solvent (e.g., kerosene or normal paraffin or blends thereof) with minor additions (usually 3 or 4 percent by weight) of "natural" additives (e.g., fatty acids, esters, peanut oil or palm oil) to control viscosity, to inhibit rust and other oxidation, and to resist extreme pressure resistant materials. These conventional lubricants are used for general purpose rolling and also for the rolling of metal strips for ultimate use in food packaging.

Such cold rolling mills also require lubrication for their mechanical parts, such as gearing, and for the pressure systems of hydraulic components, such as those which press down and lift up the upper set of rolls. Such parts lubricants are referred to herein as "mechanical lubricants". Where the rolled strip is for use in food packaging, regulations prohibit use of any quantity of certain materials in lubricants applied to strip during rolling and any mechanical lubricants which might come in contact with the strip, if any detectable level of them remains on the rolled strip. In view of that requirement, it is generally customary, in the event of an inadvertent spill of contaminating mechanical lubricant into the rolling oil, to replace the rolling oil promptly and thereby minimize the chance of finding a detectable level on the rolled strip.

Polyalkylene glycol has long been known as a lubricant for various uses, and in recent years has been used increasingly to lubricate mechanical parts of mills for cold rolling aluminum strip, subject to the no detectable level requirements of 21 CFR 178.3570. More specifically, 100% polyalkylene glycol has been used to lubricate roll bearings, and 25 to 75% polyalkylene glycol has been blended with petroleum solvent to serve as the hydraulic fluid for operating hydraulic cylinders, such as those which press the rolls together.

SUMMARY OF THE INVENTION

In accordance with the invention, polyalkylene glycol is used in the rolling lubricant for metal strip in proportions of 0.1 to 25% by volume of polyalkylene glycol, the balance being substantially all petroleum rolling oil of the kind known in the trade as petroleum solvent. This provides superior lubricity and thereby faster rolling or less power consumption, or a balance of both. The present preferred range of polyalkylene glycol in the cold rolling lubricant is about 1 to 5% by volume.

Such use of polyalkylene glycol in rolling oil is preferably combined with use of larger proportions of polyalkylene glycol in the mechanical lubricant capable of leaking into the rolling oil of the mill which rolls the strip (up to 100% in the case of bearing lubricants, for example). Such combined use is helpful in preventing contamination of the principle additive in the rolling lubricant when there are inadvertent spills or leaks of mechanical lubricant into the sump from which the rolling lubricant is drawn for reuse.

BRIEF DESCRIPTION OF THE DRAWING

The accompanying drawing schematically illustrates a presently preferred form of rolling mill for practicing the invention.

DETAILED DESCRIPTION OF PRESENT PREFERRED EMBODIMENT

Referring now more particularly to the drawing, there is shown a rolling mill 10, a horizontal length of strip 12 passed through the mill, a pair of work rolls 14 rolling the respective top and bottom surfaces of the strip, and a pair of back-up rolls 16 rolling against the work rolls 14. The end of the rolls 14 and 16 have trunnions journaled in bearings 18 mounted in the mill. Hydraulic cylinders 20 are operable to raise or press down on the bearings of the trunnions of the upper rolls.

Sprayers 22 direct lubricant 24 onto strip 12 and rolls 14 as the strip enters the rolls. All but a small portion of the lubricant 24 is removed by being scraped or blown off the rolls, or by being squeezed off where the work rolls engage the strip and where the back-up rolls engage the work rolls. The lubricant thus removed falls down into the sump 26 beneath the rolls. A pump 28 draws off lubricant collected by sump 26 and recycles it to sprayers 22.

The sprayed lubricant 24 serves to cool the strip and rolls, and the small portion which passes through the rolls where they engage the strip or each other has the lubricating function of preventing contact and hence adhesion where such engagement occurs. The lubricating function is particularly important where the strip is being reduced in thickness as it passes between the work rolls, because the resultant elongation of the strip not only presents freshly formed areas of metal surface unprotected by an oxide coating, but also causes a differential in surface speed between the strip and contacting work roll surface. In any case, whatever the explanation, variations of rolling mill oil components have been shown to affect rolling speed and power consumption.

In accordance with the invention, the lubricant 24 contains about 0.1 to 25 percent by volume of polyalkylene glycol, the balance consisting essentially of petroleum solvent. Said balance is preferrably only petroleum solvent, but may include up to 25% (by volume in the whole lubricant) of additives capable of inhibition of oxidation, including rust of metal parts, or capable of modifying viscosity, or capable of resisting extreme pressures. The present preferred range of the polyalkylene glycol is about 1 to 5 percent by volume in the lubricant, especially for cold rolling aluminum alloy strip.

The mill 10 also uses a liquid lubricant for its bearing 18 and other such mechanical operating parts, and similar liquid for operating the hydraulic cylinders 19. In accordance with the invention, all of these mechanical (including hydraulic) operating liquids which are capable of leakage into sump 26 consist of the petroleum solvent used in the rolling oil and polyalkylene glycol, but in different proportions than in the rolling oil (about 5 to 100% polyalkylene glycol and about 10 to 95% petroleum solvent), the balance being less than about five percent of rust and other oxidation inhibitors, viscosity modifiers, and extreme pressure resistance modifiers. Simultaneous use of polyalkylene glycol for supplying sprayers 22 and for use in the mechanical parts of the mill simplifies avoidance of contamination of the contents of sump 26 when inadvertent leakage and spills of any of the mechanical lubricants occurs, and thereby avoids the need for clean ups and rolling lubricant replacement which might otherwise be necessary.

For purposes of the invention polyalkylene glycol is a propylene oxide derivative having the basic formula: $C_4H_9[OCH_2—CH(CH_3]_nOH$, where n is at least 16, and the molecular weight is in the range of about 1500 to 2500. The CAS name is poly[oxy(methyl-1,2-ethanediyl)]a-butyl-w-hydroxy- and common names are alpha-Butyl-omega-hydroxypoly(oxypropylene), or Butoxy Polyoxypropylene Glycol, or Butoxy Polypropylene Glycol. Presently preferred examples are those supplied by Union Carbide Corp. under its "UCON" trademark and in its LB series, especially LB1145 (molecular weight averaging about 2080). The LB series is water insoluble butoxy polypropylene glycol produced by reacting n-butanol with propylene oxide.

While present preferred methods and apparatus for practicing the invention have been illustrated and described, it will be understood that the invention is not limited thereto, but may be otherwise embodied and practiced within the scope of the following claims.

I claim:

1. A method of rolling metal in a mill having superimposed work rolls and backup rolls, and having mechanical means controlling operation of said rolls during rolling, comprising applying to the metal passing into the nip of a pair of said work rolls a non-aqueous liquid rolling lubricant consisting of about 0.5 to 25 percent by volume of polyalkylene glycol, the balance being principally petroleum solvent, providing lubricant to said mechanical means substantially entirely consisting of about 5 to 100 percent polyalkylene glycol and about 10 to 95 percent petroleum solvent, collecting the used rolling lubricant in a sump located beneath said rolls, also collecting in said sump at least part of any leakage of said lubricant of said mechanical means during operation of the rolls, admixing the collected roll lubricant with the collected leaked lubricant, and using the admixture as at least part of the rolling lubricant during subsequent rolling in the mill, whereby compatability of the constituents of the rolling lubricant and of the leaked mechanical lubricant is improved for purposes of continued use of the recycled rolling lubricant.

2. The method of claim 1, in which the proportion of polyalkylene glycol in the liquid rolling lubricant applied to the strip is about 1 to 5 percent by volume.

3. The method of claim 2 in which the metal is an alloy containing at least 50 percent by weight of aluminum.

4. The method of claim 1, in which said lubricants applied to the mechanical parts are substantially entirely polyalkylene glycol.

5. The method of claim 1, in which the polyalkylene glycol has a molecular weight in the range of about 1500 to 2500.

6. The method of claim 5, in which the polyalkylene glycol is butoxy polypropylene glycol.

7. The method of claim 1, in which said leaked lubricant includes lubricant leaked form hydraulic roll holddown means.

8. The method of claim 1, in which said leaked lubricant includes lubricant leaked from bearing means supporting the rolls.

* * * * *